United States Patent [19]

Schaaf et al.

[11] 4,367,978

[45] Jan. 11, 1983

[54] DEVICE FOR PREVENTING BEACH EROSION

[76] Inventors: Cecil Schaaf; Craig Schaaf, both of 3015 Palmer Rd., Standish, Mich. 48658

[21] Appl. No.: 186,941

[22] Filed: Sep. 15, 1980

[51] Int. Cl.[3] ..... E02B 3/04

[52] U.S. Cl. ..... 405/30; 405/21; 405/35

[58] Field of Search ..... 405/15–35

[56] References Cited

U.S. PATENT DOCUMENTS

| | | | |
|---|---|---|---|
| 2,474,786 | 6/1949 | Humphrey | 405/30 |
| 2,755,631 | 7/1956 | Hayden | 405/34 |
| 3,280,569 | 10/1966 | Wosenitz | 405/34 |
| 3,386,250 | 6/1968 | Katayama | 405/33 |
| 3,844,125 | 10/1974 | William | 405/33 |
| 4,129,006 | 12/1978 | Payne | 405/31 |

FOREIGN PATENT DOCUMENTS

| | | | |
|---|---|---|---|
| 407575 | 3/1910 | France | 405/30 |
| 2367146 | 5/1978 | France | 405/30 |
| 877057 | 9/1961 | United Kingdom | 405/30 |
| 708344 | 4/1965 | United Kingdom | 405/30 |

*Primary Examiner*—Dennis L. Taylor

*Attorney, Agent, or Firm*—Cullen, Sloman, Cantor, Grauer, Scott & Rutherford

[57] ABSTRACT

An off-shore reef-like structure for preventing beach erosion. The structure comprises a string of prism-shaped modules placed in side-by-side relation in the surf area along a line defined by a sand bar, for example, where waves normally break. Each module has oppositely inclined front and rear walls adapted to face seaward and landward, respectively. At least one flow control passage extends through the module so as to converge from its front to rear wall openings. Incoming waves flow through the passage in a manner dissipating the wave energy while minimizing the wave impact forces tending to move the module. An opening is provided in the module bottom wall in communication with a through conduit enabling the module to fixedly seat or interlock itself in either sandy or coral-like shoreline areas. The module is uniquely designed to provide a minimal air lifting load for helicopter installation.

15 Claims, 5 Drawing Figures

DEVICE FOR PREVENTING BEACH EROSION

BACKGROUND OF THE INVENTION

The present invention relates to beach erosion protection and restoration structures and, more particularly, to slotted prism-shaped modules adapted to be placed in side-by-side relation to define an offshore reef-like barrier.

Many forms of breakwater structures have been proposed to retard beach erosion by resisting or calming wave energy. Prior arrangements include permeable or perforated seawalls located along beach surfaces or exposed shorelines for breaking the force of incoming waves and causing the deposit of suspended sand. Examples of prior patents disclosing such structures are U.S. Pat. Nos. 2,191,924 and 2,474,786, each issued to H. J. Humphrey; U.S. Pat. No. 2,755,631, issued to D. H. Hayden; U.S. Pat. No. 3,387,458 issued to G. E. Jarlin; U.S. Pat. No. 3,844,125 issued to J. D. Williams; and U.S. Pat. No. 3,894,397 issued to S. S. Fair. While each of these patented structures offer some measure of control to reduce or minimize beach erosion, they have not provided a solution to the problem of stopping and reversing the erosion process.

Among the faults of the prior structures is that they are not only expensive to install but are objectionable because of their adverse affect on the aesthetic and recreational use of the beaches. Further, the wave energy-resistant character of seawall-like structures shorten their service life and cause beach erosion along their frontal areas.

The present invention proposes to solve these various problems and limitations of prior erosion control devices by providing an offshore reef-like system comprised of prism-shaped slotted modules which are placed in side-by-side array in a surf or wave breaking area. The modules not only stop shoreline erosion from high water and wave action, but contribute to beach restoration when sedimentation is available.

It is an object of the present invention to provide an off-shore beach erosion-preventing precast concrete module including one or more flow control passages for dissipating energy of incoming waves and retaining outgoing waves to provide sedimentation while attaining a minimal air-liftable load to enable installation by helicopter.

It is another object of the present invention to provide a beach erosion-preventing module as set forth above which is adapted to seat itself in a fixed manner on off-shore wave breaking surf floor areas ranging from silt or sand conditions to rocky or coral conditions.

It is yet another object of the present invention to provide a beach erosion-preventing module as set forth above which minimizes impacting wave forces tending to overturn the module.

SUMMARY OF THE INVENTION

In accordance with the present invention, the above-described and other disadvantages of the prior art are overcome by providing a prism-shaped module having one or more converging passages extending therethrough. A series or string of modules are designed to be arrayed in a side-by-side manner in an off-shore surf area of a beach so as to parallel or follow the general contour of the shoreline. The module has oppositely-inclined front and rear walls with the lower inclined front wall directed seaward and the steeper inclined rear wall directed landward to provide a wave energy-absorbing off-shore reef-like barrier. The passages are operative for attenuating the incoming wave energy by funneling water through while the rear wall reacts with outgoing waves causing sedimentation or the accretion of sand on the module landward side.

The seaward facing front wall has a relatively small angle of inclination with its bottom wall while the landward facing rear wall has a relatively steep angle of inclination with the bottom wall. The resulting symetrical prism-shaped module minimizes the impact forces of incoming waves to assist in preventing the module from being moved from its installation site, while maximizing the retarding forces on outgoing waves. This retarding force, together with the converging passages having smaller openings in the rear wall, results in the accretion of alluvium on the shoreline floor adjacent the landward facing rear wall. Thus, when the modules are arrayed as a side-by-side submerged off-shore reef-like structure, they will reduce the destructive force of the surf and will, when sedimentation is available, enable the beach to grow both in width and height.

The unique bottom wall of the present invention may either positively interlock with rocky surf floor areas or embed itself in sandy or sediment covered floor areas. A central opening is provided in the module bottom wall which communicates with a flow control conduit. Upon the module being initially installed on a sandy floor incoming wave currents flow into a front wall opening of the conduit and impact on internal vertical wall portions of the module. The impacting action of the successive wave currents creates alternate downwardly and upwardly directed flows into and out of the module central opening causing sediment beneath the module to be eroded and pulled or drawn upwardly into the conduit. This internal "sea wall" effect results in portions of the bottom wall becoming embedded in the eroded sediment to assist in preventing the module being moved during high wave conditions.

In rocky or coral surf floor obstructed areas the module bottom wall opening and overlying conduit allow rock outcrops, up-standing coral reef formations or the like to be received within the bottom wall opening and occupy portions of the conduit. In this manner the module becomes interlocked with such obstructions such that it is positively retained in place on the surf floor to insure its proper orientation with the shoreline and adjacent modules.

By virtue of it triangular prism-shape, the module has a low center of gravity which enables it to resist the impacting forces of waves. Further, during high water storm conditions the triangular shaped side walls provide reduced upper sidewall areas and thus lessen side slipping forces.

Still another feature of the triangular prism-shape is that the front and rear oppositely inclined walls define knife-like edges with the bottom wall. Thus, the resultant net downward components of the static and dynamic water pressure forces acting on the module cause the knife-like edges to dig into sandy floor areas to provide increased resistance to movement by impacting waves.

A related feature of the prism-shaped design is that when submerged, the effective area of the hydrostatic loaded surfaces establish a net downwardly acting pressure differential assisting the module gravitational force in resisting the tendency of the module to be overturned by the impacting force of incoming waves.

The foregoing objects and advantages of the present invention, together with objects and advantages which may be attained by its use, will become more apparent upon reading the following detailed description taken in conjunction with the drawings.

DETAILED DESCRIPTION

Figure 1:
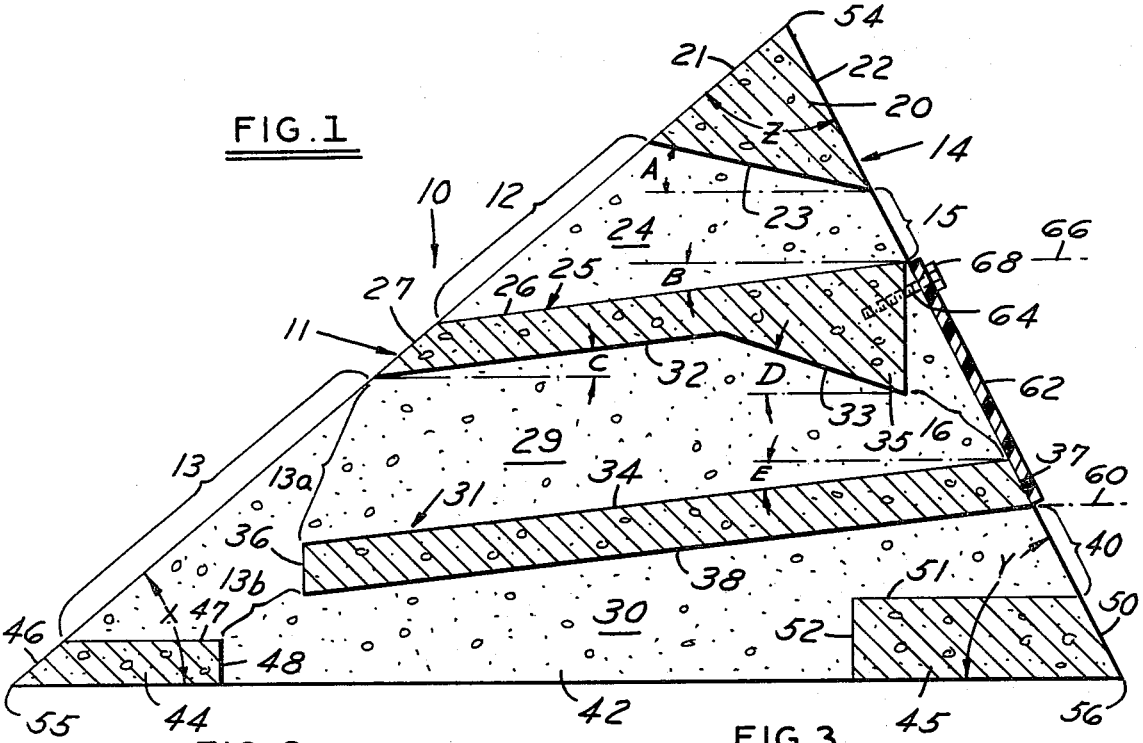
FIG. 1 is a vertical sectional view taken on line 1—1 of FIG. 3 of a preferred form of the present invention to show details thereof.
Figure 2:
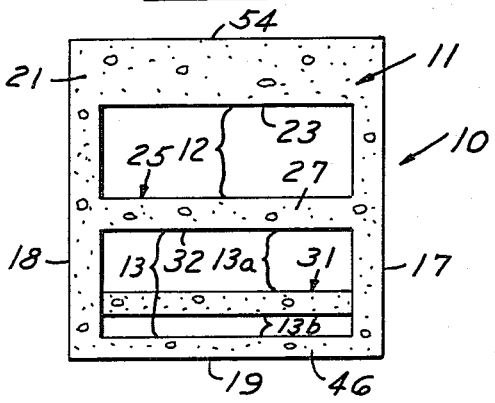
FIG. 2 is an elevational view of the front wall of the module of FIG. 1.
Figure 3:
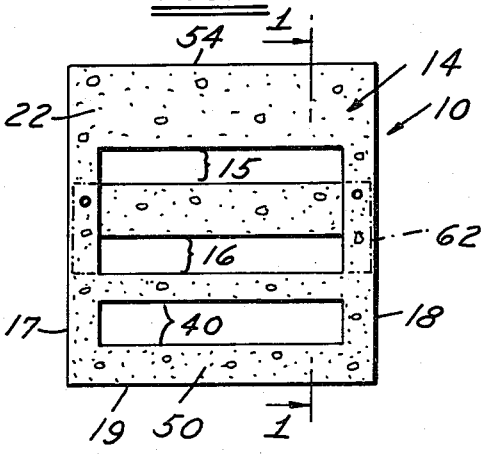
FIG. 3 is an elevational view of the rear wall of the module.

Referring now to FIG. 1, there is shown at 10 a preferred form of beach erosion protection module of the present invention. The module is shown having a generally triangular prism-shaped configuration defining a front inclined wall 11 adapted to face seaward having an upper front wall inlet opening 12 and a lower front wall inlet opening 13 formed therein. As seen in FIG. 2, the inlet openings 12 and 13 are substantially rectangular and equal in width with the lower opening 13 having a greater dimension measured along the inclined surface or slant height of the front wall. The lower opening 13 has bifurcated upper and lower recessed internal inlet sub-openings 13*a* and 13*b*, respectively, for a purpose to be explained. The module has a rear oppositely inclined wall 14 including an upper passage rectangular opening 15 and a lower passage rectangular opening 16. The rear wall passage openings 15 and 16 are substantially equal in width and define nozzle-like sharp-edged orifices.

As viewed in FIG. 2, the module further includes a right side wall 17 and a left side wall 18 being substantially parallel and extending in vertical planes from rectangular bottom wall 19. The module further includes a crown section 20 in the form of a transverse elongated trihedron-like section. The crown section in the disclosed form is triangular in vertical section defining a seaward facing surface area 21, a landward facing surface area 22 and an internal rearwardly tapered surface 23 of upper passage generally indicated at 24. A transversely extending shelf-like upper divider member 25 has an upper side which defines the base surface 26 of the upper passage.

FIG. 1 shows the converging passage 24 having its upper surface 23 tapered downwardly in a direction from the front wall 11 to the rear wall 14 at a defined angle indicated at A. In the disclosed form, the tapered surface angle A is about $11\frac{1}{2}$ degrees from the horizontal.

The base surface 26 of the passage 24 is sloped upwardly at a defined angle to the horizontal in the direction from the front wall 11 to the rear wall 14. The slope angle of the base surface 26, indicated by the angle B, in the preferred embodiment is about 7 degrees. The upper divider member 25 has a front seaward facing edge surface 27 located in the plane of the front wall 11 and a landward facing rear edge surface 28 disposed in a substantially vertical plane.

The module has formed therein a lower passage 29 and bottom conduit 30 separated by a lower divider member 31. The lower passage 29 communicates with the front wall opening 13 by means of its sub-opening 13*a* and is defined by an upper surface portion 32 sloped upwardly from the front opening 13 in a direction towards the rear wall 14 at a defined angle indicated at C. As the divider surfaces 26 and 32 are parallel the angle C is a corresponding angle equal to the angle B, i.e., of the order of 7 degrees. The lower passage 29 converges by virtue of upper rearward tapered surface portion 33 which slopes downwardly toward the rear wall 14 at a predetermined angle D. In the disclosed form angle D is of the order of 20 degrees from the horizontal. The passage 29 has its base surface 34 defined by the top side of the divider 31.

The upper divider 25 has an integrally molded or cast appendage 35 formed along its lower rear portion which projects downwardly from the bottom surface 32. This wedge-shaped appendage functions to provide an enlarged vertical wave reaction surface area 28 to aid in retaring outgoing waves.

The lower passage 29 base surface 34 slopes upwardly in a direction from the module front wall 11 to its rear wall 14 at a predetermined angle E of about 7° from the horizontal in the form shown. The lower divider member 31 is defined by a seaward facing frontal vertical internal edge surface 36 and a landward facing edge surface 37 in the inclined plane of the module rear wall 14. The internal edge surface 36 is positioned a defined longitudinal distance rearwardly from the module front wall opening 13. This, together with its vertical orientation, causes water currents from incoming waves entering the front wall opening 13 to impact or impinge on edge surface 36 resulting in portions of the flow being downwardly directed through recessed opening 13*b*.

The above described arrangement defines upper and lower passages 24 and 29 which converge from relatively large rectangular shaped openings 12 and 13 respectively, in the module front wall 11 to relatively small rectangular shaped openings 15 and 16, respectively, formed in the rear wall 14. Both of the passages 24 and 29 are thus operative for attenuating or dissipating the energy of in-coming wave currents flowing into the module front wall openings 12 and 13. As a result, with sediment material available, there is an accretion of suspended sand or other alluvium on the shoreline floor adjacent the module landward rear wall 14. With the rear wall openings 15 and 16 being of reduced size the module is substantially less permeable to out-going waves reflected from the shore. Thus, further sedimentation results on the landward side of the module.

The sloped base surfaces 26 and 34 of the passageways 24 and 29, respectively, are adapted to respond to impingement or impact forces of incoming waves. The wave currents flowing into the front wall openings 12 and 13 cause resultant downwardly acting dynamic force components on the sloping base surfaces 26 and 34, respectively, which assist the hydrostatic pressure loads acting on the module in maintaining it at a fixed location on the shoreline floor. Similarly, the sloping surfaces of front inclined wall 11 located beyond each opening 12, 13 contribute to the downward hydrostatic and hydrodynamic forces which help to stabilize the module. It will be noted that because of the prism-shaped design, the hydrostatic forces are greater at greater depths where the effective horizontal projected areas of the passages are greater. Thus, during the most severe high water storm condition, this configuration further enhances the ability of the module to resist the tendency of incoming waves to overturn or displace the module.

FIG. 1 shows the bottom conduit 30 defined by an upper surface 38 which slopes in an upward direction from the front recessed lower opening 13*b* to a rear wall opening 40. The front and rear openings 13*b* and 40, respectively, of the bottom conduit 30 are in communication with a central opening 42 formed in the bottom wall 19 of the module. In the preferred form, the opening 42 is substantially rectangular-shaped in plan and is defined at its front end by bottom wall transverse toe slab section 44 and rear bottom wall transverse heel slab section 45. The module toe section 44 includes a frontal sloped surface 46, an upper horizontal surface 47 and vertical transverse edge surface 48. The transverse rear heel portion 45 includes a landward facing rear wall surface 50, an upper horizontal surface 51, and a vertical inner transverse surface 52.

The module bottom wall opening 42 and its associated bottom conduit 30 allows each module to readily seat or imbed itself on a surf area shoreline floor in juxtaposition with its adjacent side-by-side arrayed modules. With the module located on a sedimentation surf area, such as a sand bar, water currents resulting from incoming wave action flow through the conduit recessed opening 13*b*. A portion of the incoming wave flow impacting on internal edge surface 36 will be directed vertically by intense turbulent currents. The downward acting water currents churn and loose sediment material beneath the bottom wall 19 of the module. A "sea wall" effect is thus established by the vertical edge 36 being transverse to the wave path and exposed to their impact. The successive surges of the waves create alternate up and down flows causing sand or the like to be drawn or sucked up through opening 42 from beneath the module bottom wall. This eroding action in cooperation with the module weight and the hydrostatic and hydrodynamic pressure forces cause the module toe section 44 to become imbedded in the sand from the shoreline floor. A similar action occurs at heel portion 45 as a result of turbulence caused by surface 52. This action helps to stabilize the module and secure it against displacement from its intended position.

When the module is placed in rocky or coral-like shoreline areas, the bottom opening 42 receives upwardly projecting or jagged portions of the rocks or coral causing the module to become interlocked with such formations and thus be retained at a fixed location. The module's inherent interlocking or embedding bottom wall and conduit design enables the module to adapt to a wide range of submerged shoreline or surf floor conditions in side-by-side relation with other modules.

The modules of the present invention are designed for placement in an off-shore surf or reef area in a substantially submerged manner at mean water levels about equal to or slightly below the module's height. It has been determined therefore that helicopter airlift installation is the most practical means presently known for installing the modules. The air lifting of the modules by helicopter places a severe upper weight limitation on the units. While helicopters are capable of airlifting modules up to 4,000 pounds, as a practical matter it has been determined that modules weighing in excess of 3,500 pounds limit the acceptable working range of the helicopter.

As a result, it is important that the module be cast with a minimal volume of concrete for airlift considerations while having sufficient weight to insure that the module can absorb wave energy without being moved from its installed site. The bottom wall opening not only facilitates the module being imbedded or interlocked in place on sandy or bedrock sites but significantly reduces the overall weight of the unit to meet the 3,500 pound limitation.

A further stabilizing effect of the unique module design is that the truly vertical surfaces are minimized and are replaced by inclined surfaces most of which are sloped in a direction so that the impact force of incoming waves generates a downward force component which aids in stabilizing the module. The result is the module is dimensioned and shaped to establish net downwardly acting static and dynamic pressure loads to assist in minimizing the overturning tendency caused by the impact of wave action.

Figure 5:
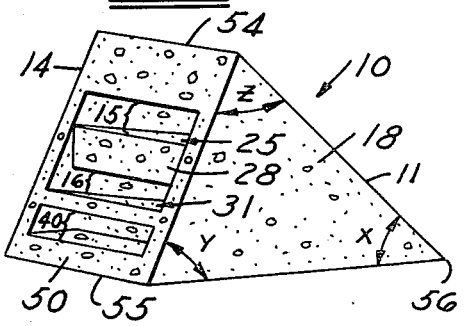
FIG. 5 is a perspective view of the module of the present invention.

As best seen in FIG. 5 the triangular prism-shaped module in its preferred form is asymmetrical in longitudinal section such that the front wall 11 defines a predetermined angle of inclination "X" with the bottom wall 19 which is substantially smaller than the angle of inclination "Y" between the rear wall 14 and the bottom wall 19. In the disclosed embodiment, the angle "X" is of the order of $62\frac{1}{2}$ degrees while the angle "Y" is of the order of 40 degrees. As a consequence, the remaining angle "C" at the crown, is of the order of $77\frac{1}{2}$ degrees.

The specific angles for the disclosed form of the module are established by the module dimensions, i.e., an overall height of about 4 feet with an overall bottom wall dimension from front to rear of about 7 feet. The resultant small angle of inclination "X" provides a low front wall silhouette angle and a corresponding rear wall having a relatively steep silhouette angle. The net effect is to minimize the impacting forces of in-coming waves on the module front wall 11 to reduce the module-displacing forces. In counter-distinction, the steep angle of inclination of the rear wall 14 is adapted to maximize the retarding force applied by the module to out-going waves, causing sedimentation or the accretion of alluvium on the shoreline floor. The module converging passages 24 and 25 provide reduced area openings 15 and 16 which assist in the desired sedimentation by retarding outgoing wave flow. Similarly, the large vertical area of surface 28 further increases the retarding action on out-going waves.

It will be noted in FIG. 5 that the prism-shaped module in its disclosed form has scalene triangular side walls 17 and 18, i.e., having three unequal sides. The longest side of the triangle defines the front to rear dimension of the bottom wall 19 while the next longest side defines the slant dimension of the front wall 11 adapted to face generally seaward. The shortest side of the triangle defines the slant dimension of the rear wall 14 adapted to face generally landward. Further, the triangular side walls establish an apex or top edge 54 opposite to the bottom wall 19 and knife-like toe and heel edges 55 and 56 at the triangular seaward and landward vertices or angles "X" and "Y", respectively. The knife-like toe and heel edges 55 and 56 assist their associated bottom wall sections 44 and 45 respectively, in "digging in" or embedding themselves in sediment material on the shoreline floor.

The cross-sectional shape of divider member 25 is designed to contribute minimal weight while providing a converging passage 29 to retard incoming waves and also maximum vertical rearward facing surface 28 to dissipate the energy of out-going waves impinging thereon.

A weight-saving is also achieved by the recessed location of frontal edge 36 of lower divider 31, while such location also creates the desired turbulence as described above.

Figure 4:
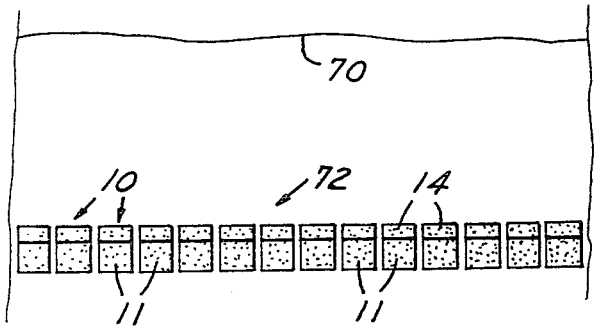
FIG. 4 is a simplified aerial view of a shoreline showing a line of side-by-side beach protecting modules located in an off-shore surf area such as on a sandbar for example, extending substantially parallel with the shoreline.

In beach erosion areas shown by the beach 70 in FIG. 4, where sufficient sedimentation is available, the sediment or sand material will readily build up to a level indicated by dashed line 60 in FIG. 1 because of the mentioned internal sea wall effect. The invention further contemplates valve means being provided on the rear wall of the module to aid in the build-up of sand in this area. In the preferred form a generally rectangular, planar flap-like valve member 62 is shown having a transverse dimension sufficient to extend beyond both sides of the lower opening 16 for flush contact with the surface of the rear wall 14. The valve member 62, preferably formed of rubber belting or other elastomeric material, is supported at its upper corners by suitable pins or hangers such as machine bolts 64 cast in the rear wall and extending normal thereto. The flap valve member 62 functions in a poppet valve manner allowing in-coming wave currents to flow through the passage 29 moving the valve member outwardly to allow the flow to exit the rear wall opening 16.

The valve member 62 also provides an additional impact barrier attenuating the energy of out-going waves resulting in increased sedimentation on the landward side of the module. Upon sufficient sediment having been deposited to reach a second level, indicated by dashed line 66, the valve member 62 may be readily removed and used to cover the rear wall upper opening 15 in a manner similar to opening 16, thereby creating further sediment build-up. It will be noted that bolt heads 68 are spaced outwardly from the module rear wall 14 to provide a gap which may be of the order of 2 inches to provide a water escape path around all sides of the valve member 62.

The flap valve member 62 is gravity biased into a normally positively closed position in flush contact with the rear wall 14 by virtue of the angle of inclination of the rear wall. The result is that additional energy of the incoming wave currents will be dissipated in lifting and flexing the valve flap member from its closed position.

A modified design may substitute a generally flattened peak or crown section 20 to replace edge 54. Such a modified design provides a reduced overall height with further module weight reduction. Another feature of such a modified shape is a lower module silhouette which remains submerged at low water levels to reduce visibility of the module from the beach, for aesthetic purposes.

A modification of modules with a flattened crown upper surface involves the placement of upright reinforcement bars extending from the upper surface. Such bars would be used to support flexible flap-like belts in a transverse vertical plane with the result that the module would provide increased wave retarding effect and sedimentation during high water conditions.

FIG. 4 shows a typical installation wherein the modules 10 are arrayed in side-by-side fashion with minimal spacing between the module side walls of the order of one-half foot or less. An artificial reef structure 72 is thus provided which substantially parallels the shoreline 70. In such an installation the line of modules 10 may create a forebeach wherein the beach 70 stabilizes. This forebeach comprises the artificial reef structure 72 as augmented by the deposit of sand along its shoreward side as well as, to a lesser extent, along its seaward side.

In the disclosed embodiment the module has a central rectangular shaped opening 42 having a front to rear dimension such that the defined area of the opening 42 is at least 50% of the total bottom wall area. Such a design provides not only optimum weight reduction but enables the bottom opening to accommodate rock outcrops, coral formations, etc., of large lateral extent. It is contemplated, however, that the module may be used in silty or loose sediment areas wherein a greater bottom wall surface would be required to prevent undue settling of the module. This could readily be accomplished by modifying the triangular prism-shape to provide a module having an angle "X" approaching 30° and an angle "Z" of nearly 90° with the toe section 44 having a corresponding lateral increase. Such a design modification is also contemplated where it would be desirable to decrease the front wall angle of inclination to counteract increased dynamic forces of incomong waves.

In its preferred form, the module is a reinforced precast concrete member having suitable reinforcing means (not shown) such as reinforcing bars, wire or welded wire fabric located in each of the side walls. It is also contemplated that reinforcing fibers formed of steel, plastic resin or the like, may be added to the concrete mix to provide additional reinforcement. The modules are formed either in wood or steel molds and cast on one side wall. The passages are formed from a core consisting of a plurality of wood sections some of which are wedge-shaped to enable their ready removal when casting is complete.

This invention may be further developed within the scope of the following claims. Accordingly, the above specification is to be interpreted as merely illustrative of a preferred embodiment, rather than in a strictly limited sense.

We now claim:

1. An off-shore erosion protection device for positioning in a substantially submerged manner on a surf area floor along a water shoreline comprising:

a prism-shaped module having a bottom wall, side walls and oppositely inclined upwardly converging front and rear walls, said front and rear walls adapted to generally face in seaward and landward directions, respectively;

at least one flow control passage extending through said module interconnecting front and rear wall openings, respectively;

said passage when submerged defining hydrostatic pressure-loaded upper and lower opposed surfaces, such that the effective projected area of said lower pressure surface exceeds the effective projected area of said upper pressure surface, wherein the differential area establishes a downwardly acting resultant hydrostatic pressure force on said module to assist the module gravitational force in retaining said module at a fixed location on the surf area floor;

said passage lower surface being sloped upwardly at a predetermined defined angle to the horizontal in the direction from said front to rear walls, whereby the cross-sectional area of said passage converges toward said rear wall;

said passage characterized in that its sloped lower surface is adapted to respond to impacting forces of incoming waves, whereby resultant downward dynamic force components on the lower surface assist the module gravitational force in retaining said module at a fixed location on the surf area floor.

2. The erosion protection device as set forth in claim 1 wherein:

said module being asymmetrical triangular prism-shaped with its front wall defining a relatively small angle of inclination with said bottom wall and said rear wall defining a relatively large angle of inclination with said bottom wall;

whereby said front wall presents a relatively low silhouette angle adapted to decrease the impact forces of the incoming waves in the module and said rear wall presents a relatively steep silhouette angle adapted to increase the impact forces of outgoing waves on the module, such that the outgoing waves have their momentum decelerated resulting in sedimentation of suspended particles therein on the surf area floor adjacent said rear wall.

3. The erosion control device as set forth in claim 1, wherein:

conduit means extending through said module adjacent said bottom wall for conducting wave currents between openings in said module front and rear walls, respectively;

said conduit means being in communication with an opening in said module bottom wall;

said conduit means and said bottom wall opening defining substantially vertically disposed interior surfaces reacting with impacting wave currents, causing downwardly directed currents to flow into said bottom wall opening to erode portions of the surf area floor beneath said module, assisting said module bottom wall in embedding itself in the surf area floor.

4. An off-shore erosion protection device for positioning on a surf area floor along a water shoreline comprising:

a prism-shaped module having a rectangular bottom wall, parallel side walls and oppositely inclined upwardly converging front and rear walls, said front and rear walls adapted to face in generally seaward and landward direction, respectively;

said side walls connected at their top edges by a longitudinally extending crown section, and at their seaward and landward lower vertices, respectively, by longitudinally extending front and rear bottom wall sections;

at least one shelf-like divider member extending between said side walls and vertically spaced from said crown section, defining a flow control passage, said passage interconnecting front and rear wall openings;

said divider member disposed at an angle to the horizontal such that its top side surface is sloped upwardly toward said rear wall;

said divider member top side surface responsive to forces of incoming waves impacting thereon whereby resultant downward hydrodynamic force components on said divider member assist the gravitational force of said module in retaining said module at a fixed location on the surf area floor.

5. The device of claim 4 wherein said module including upper and lower divider members defining a lower passage therebetween, said lower divider member interconnecting front and rear wall openings; said upper divider member having an enlarged substantially vertical rearward-facing edge surface to aid in retarding outgoing water currents to thereby cause sedimentation on the surf area floor;

said lower slotted passage converges toward said rear wall, such that the energy of incoming wave currents flowing therethrough is dissipated.

6. The device as defined in claim 4 wherein:

said bottom wall having an opening formed therein defined by said side walls and said front and rear bottom wall sections, respectively;

said divider member bottom side surface defining with said side walls and said bottom wall sections a bottom wall conduit means connecting a module front wall opening with a rear wall opening;

said rear bottom wall section having a substantially vertically disposed longitudinally extending interior surface of a predetermined height substantially greater than the height of said front wall section, such that portions of the incoming wave currents passing through said bottom wall conduit means are caused to impact on said interior surface resulting in current flowing into said bottom wall opening eroding portions of the sediment beneath said module, assisting the module in embedding itself in the surf area floor.

7. The device as defined in claim 4 wherein:

said bottom wall having an opening formed therein defined by said side walls and said bottom wall front and rear sections;

said lower divider member having its forward edge surface in a substantially vertical plane disposed rearwardly from said bottom wall front section, such that portions of the incoming wave currents are caused to impact on said forward edge surface resulting in currents flowing into said bottom wall opening rearwardly of said bottom wall front section to erode portions of the sediment beneath said module and assist the module in embedding itself in the surf area floor.

8. The device as defined in claim 4 wherein:

said module side walls are asymmetrical triangles, with said front wall defining a relatively small angle of inclination with said bottom wall and said rear wall defining a relatively large angle of inclination with said bottom wall;

whereby said front wall presents a relatively low silhouette angle adapted to decrease the impact forces of incoming waves on the module and said rear wall presents a relatively large silhouette angle adapted to increase the impact forces of outgoing waves on the module, such that the outgoing waves have their momentum decelerated resulting in sedimentation of suspended particles therein on the surf floor adjacent said rear wall.

9. The device as defined in claim 4 wherein:

said front wall inclination from the horizontal being between about 30° to 40°, said rear wall inclination from the horizontal being between about 60° to 70°, and said top side surface of said divider member disposed at an angle with the horizontal between about 5° to 10°.

10. An off-shore erosion control module adapted to be arrayed side-by-side with similar modules to form a reef-like structure substantially parallel to the shore and positioned on a submerged surf area floor along a shoreline comprising:

each said module having a rectangular bottom wall, parallel side walls and oppositely inclined upwardly converging front and rear walls, said front and rear walls adapted to generally face in seaward and landward directions, respectively;

each module having a pair of horizontally disposed, vertically spaced upper and lower passages extending through said module, each of said passages interconnecting front and rear wall rectangular shaped openings;

each of said pair of passages having at least a portion thereof converging in a direction toward said rear wall for attenuating the energy of incoming wave currents flowing therethrough;

conduit means extending through each said module adjacent said bottom wall for conducting wave currents between openings in said module front and rear walls, respectively;

said conduit means being in communication with a central opening in said module bottom wall;

said bottom wall opening defining with said conduit means longitudinally extending substantially vertically disposed internal surface means reacting with successive impacting waves causing downwardly directed wave currents to flow in a turbulent manner into said bottom wall opening to erode and draw-up portions of the surf area floor sediment through said bottom wall opening to assist said module in embedding itself in the surf area floor.

11. The structure as defined in claim 10 wherein:

each module having its pair of upper and lower passages separated by an intermediate shelf-like divider member;

said divider member having its top and bottom side surfaces adjacent said front wall located in substantially parallel upwardly and rearwardly inclined planes.

12. The structure as defined in claim 10, wherein:

each module having its pair of upper and lower passages being separated by an intermediate shelf-like divider member;

said divider member having a wedge-spaced section formed on its bottom side surface along its rearward edge;

said wedge-shaped section defining intersecting first and second surfaces;

said first surface providing a rearwardly and downwardly sloping surface of said converging lower passage;

said wedge-shaped section second surface providing a rearwardly facing, substantially vertical wave reaction surface, wherein outgoing waves impact thereon to assist said module in causing sedimentation.

13. An off-shore erosion protection device for positioning on a surf area floor along a water shoreline comprising:

a prism-shaped module having a rectangular bottom wall, parallel side walls and oppositely inclined upwardly converging front and rear walls, said front and rear walls adapted to face in generally seaward and landward direction, respectively;

said side walls connected at their top edges by a longitudinally extending crown section, and at their seaward and landward lower vertices, respectively, by longitudinally extending front and rear bottom wall sections;

at least one shelf-like divider member extending between said side walls and vertically spaced from said crown section to define a flow control passage therebetween;

said passage interconnecting rectangular shaped front and rear wall openings;

said divider member vertically spaced above said front and rear bottom wall sections and defining therewith bottom conduit means interconnecting front and rear wall openings with a bottom wall opening;

said module characterized in that portions of the wave currents channeled through said conduit means are caused to impact on inner surface portions of said module defining said bottom wall opening so as to flow into said bottom opening to erode subjacent sediment material, whereby sediment material is drawn upwardly through said bottom wall opening by succeeding wave currents to assist in embedding said bottom wall sections on the surf area floor.

14. The structure as defined in claim 4, which further comprises:

valve means in the form of a flexible valve flap member secured adjacent its upper edge portion to the rear wall of said module so as to overly said rear wall opening, said valve flap member being gravity biased into a normally closed position in positive flush contact with said inclined rear wall whereby outgoing waves are caused to impact thereon and retain said valve means in its closed position, resulting in sedimentation adjacent said module;

and wherein incoming wave currents flowing through said passage toward said rear wall impinge on said flap member causing its free lower edge portion to be flexed outwardly from said module rear wall and allowing incoming wave currents to exit said passage.

15. The structure as defined in claim 10, which further comprises:

valve means in the form of a flexible valve flap member secured adjacent its upper edge portion to the rear wall of said module so as to overly said rear wall opening of said lower passage, said valve flap member being gravity biased into a normally closed position in positive flush contact with said inclined rear wall whereby outgoing waves are caused to impact thereon and retain said valve means in its closed position resulting in sedimentation adjacent said module;

and wherein incoming wave currents flowing through said lower passage toward said rear wall impinge on said flap member causing its free lower edge portion to be flexed outwardly from said module rear wall and allowing incoming wave currents to exit said lower passage.

* * * * *